United States Patent [19]

Weiner

[11] 4,267,542

[45] May 12, 1981

[54] THERMAL FUSE FOR ELECTRICAL APPARATUS

[76] Inventor: Norbert Weiner, 5275 Bergneustadt 2, Fed. Rep. of Germany

[21] Appl. No.: 47,261

[22] Filed: Jun. 11, 1979

[30] Foreign Application Priority Data

Sep. 21, 1978 [DE] Fed. Rep. of Germany ..... 2841114

[51] Int. Cl.[3] ..... H01H 85/14

[52] U.S. Cl. ..... 337/227; 337/291; 339/103 M; 339/107

[58] Field of Search ..... 337/186, 201, 208, 209, 337/227, 291, 414; 339/103 R, 103 M, 107

[56] References Cited

U.S. PATENT DOCUMENTS

| | | | |
|---|---|---|---|
| 1,372,361 | 3/1921 | Martin | 337/416 |
| 3,156,514 | 11/1964 | Wing et al. | 339/107 X |
| 3,855,567 | 12/1974 | Harms et al. | 339/107 X |
| 3,954,320 | 5/1976 | Hardesty | 339/103 M X |
| 4,195,898 | 4/1980 | Chow et al. | 339/103 R X |

FOREIGN PATENT DOCUMENTS

| | | | |
|---|---|---|---|
| 1566695 | 3/1969 | France | 337/227 |
| 182194 | 1/1936 | Switzerland | 337/227 |

*Primary Examiner*—George Harris

*Attorney, Agent, or Firm*—Gifford, VanOphem, Sheridan & Sprinkle

[57] ABSTRACT

A thermal fuse apparatus comprising an insulating body and a fuse having a fuse body and a pair of connecting wires. The wires are inserted through passages in the insulating body, and the body includes recesses intersecting said passages so that a portion of the fuse wires are exposed exteriorly of the insulating body and excessible to counter contacts in an electrical appliance.

13 Claims, 7 Drawing Figures

THERMAL FUSE FOR ELECTRICAL APPARATUS

The present invention relates to a thermal fuse for electrical apparatus, said fuse being insertable, in use, into a holder formed in the apparatus or capable of being fitted therein. Such a fuse would have a thermally influenceable fuse element with connecting wires and an insulating body for holding the fuse element, the fuse element being securable to the insulating body by means of its connecting wires in such manner that the said connecting wires are contactable by countercontacts of the holder.

The advantage of such fuses resides in the feature that the insulating body, its shape adapted to a specific holder, can be formed by an economically manufactured plastic part, whilst the actual fuse element may have any desired shape, provided that the size of fuse element does not exceed the limits set by the capacity of the holder. The same insulating bodies suitable for a specific holder may therefore be connected to fuse elements of different type and shape.

The object of the present invention, in a thermal fuse of the above described type, is to construct the insulating body so that, between the insulating body and the fuse element, a connection can be established in a simple manner and with very little time consumption which ensures reliable contact between the connecting wires of the fuse element and the corresponding countercontacts of the holder when the fuse is inserted into said holder.

According to the present invention there is provided a thermal fuse for electrical apparatus, said fuse being insertable, in use, in a holder formed in the apparatus or capable of being fitted therein, and comprising a thermally influenceable fuse element with connecting wires and an insulating body for holding the fuse element, said fuse element being securable to the insulating body by means of its connecting wires in such manner that the connecting wires are contactable by countercontacts of the holder, the insulating body being provided with insertion passages for receiving the connecting wires and having, in a center portion of the length of the insertion passages, at least one opening extending substantially perpendicularly to the axis of the passage, so that the connecting wires introduced into the said at least one insertion passage, is located at least partially free in a center portion of its length.

The wires held in the insertion passages are therefore located freely at least at one point at which a correspondingly shaped contact tab of the holder can come into contact with the connecting wire through the opening.

The openings are preferably dimensioned so that the particular connecting wire can be bent out of the axis of the passage in the center portion of its length. This means that the connecting wire is held on both sides of the opening in the insertion passage and, in the region of the opening, is bent out, in an arcuate form, from the axis of the passage. The result of this is that, on the one hand, the fuse element with its connecting wires can no longer be drawn out of the insertion passages without the use of force and is thus firmly connected to the insulating body. On the other hand, the portions of the connecting wires extending out of the openings, form sliding contacts for making contact with corresponding contact parts of the holder. Thus the countercontacts in the holder can be formed more simply.

In order to facilitate the bending of the contact wires out of the axis of the passage, the openings preferably extend transversely of the axis of the passage through the entire insulating body. In this case it is sufficient to introduce a suitable tool on one side of the openings and to press the connecting wire through towards the other end of the openings until the resultant wire arc projects out of the openings by its other end.

In practice, in the mass production of fuses, special tools, suitable for shaping the connecting wires, will be used. However, as an example, to give the manufacturer of apparatus who fits the thermal fuses of the present invention in his apparatus, a possibility of combining fuse elements of different types with the same insulating body without the above mentioned special tools being required for the purpose, it is proposed that, in the region of the openings, on one side of the particular insertion passage, the insulating body should be provided with a pressure member which can be pressed into the opening. This pressure member would, suitably, be removably connected, by tear-off strips, to the insulating body before being pressed in, and projects beyond the lower surface of the insulating body. This will extremely simplify the assembling of the fuse element of the insulating body. After the insertion of the connecting wires in the insertion passages, it is only necessary to clamp the insulating body between two flat plates to press the pressure members, extending beyond the surface of the insulating body, into the openings, which member then presses the connecting wires out of the axis of the passage. These flat clamping plates may be formed, in the case of small insulating bodies, for example, by the jaws of an ordinary pair of flat pliers. So that the manufacture of the insulating bodies is not made more expensive by the pressure members, the particular pressure member is preferably made in one piece with the insulating body and connected thereto by means of a bridge of material which is thin relative to the insulating body and to the pressure member. This bridge of material forms a weak breaking point at which the material breaks when the insulating member is clamped.

The insulating body is preferably designed so that the width of the pressure members, measured transversely of the axis of the passage and the direction of insertion, is somewhat larger than the width of the openings at the same points and that the openings, on at least one side are limited by an elastically deformable wall. Thus the pressure members, after being inserted into the openings, are firmly held with a clamping action by the walls thereof.

In order to raise the connecting wire, by the particular pressure member, above the surface of the insulating body, the dimension of the pressure member, in the direction of insertion, is approximately equal to the thickness of the insulating body in the same direction. Thus, when the insulating body is clamped between the two flat plates, the connecting wire is raised above the surface of the insulating body by an amount corresponding approximately to its diameter. In order to prevent the connecting wire from being squashed, ribs are preferably formed on the surface of the insulating body opposite to the pressure members in their initial position, the height of said ribs being approximately equal to the inner diameter of the insertion passages and hence to the outer diameter of the connecting wire. These ribs may, for example, be formed as an edge bead enclosing the said surface. Thus, if the insulating body is clamped between two plane plates, one plate is in contact with the ribs or the edge bead, so that sufficient play is present, for the connecting wire to be pressed out of the opening by the pressure member.

In order to ensure that the connecting wire, when being pressed out of the opening, assumes a quite definite position and is thus brought opposite to a countercontact of the holder, it is proposed, in accordance with the present invention, that the dimension of the pressure elements transversely of the axis of the passage and of the direction of insertion, is greater than the diameter of the insertion passages and that the pressure members have a channel-like depression extending parallel to the particular insertion passage, the radius of curvature of said depression being approximately equal to the radius of the particular insertion passage.

The present invention will be described further by way of example, with reference to the accompanying drawings, in which.

Figure 1:
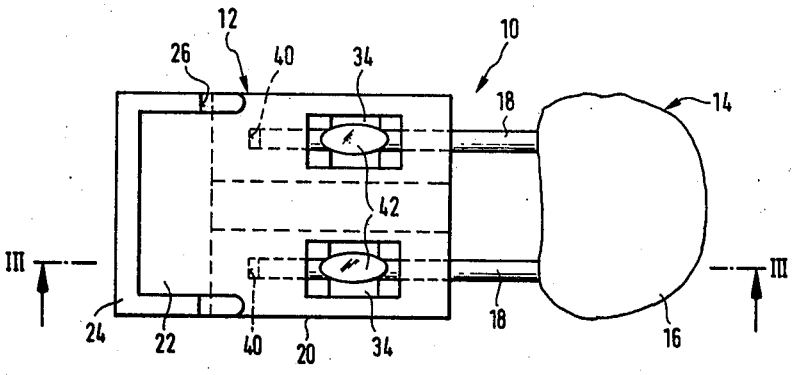
FIG. 1 is a plan view of a thermal fuse according to a first embodiment of the present invention.

FIG. 1 shows a thermal fuse, indicated in general by 10, according to a first embodiment of the invention, comprising an insulating body 12 and a fuse element 14 mounted thereon. For the fuse elements 14, ordinary commercial temperature fuses are concerned which are connected in a circuit of an electrical appliance and which switch off the appliance by automatically opening the circuit when the normal operating temperature of the appliance is exceeded and overheating takes place. The fuse element 14 comprises a fuse body 16, which contains the actual fuse, the construction of which need not be dealt with in detail, and two connecting wires 18 by which the fuse element 14 is secured to the insulating body 12 in a manner, to be described hereinafter, so that when the fuse 10 is inserted into a holder provided in an electrical appliance, the connecting wires 18 may be brought into contact with corresponding countercontacts in the holder.

The insulating body 12 comprises a flat substantially rectangular plate 20 to which a handle 22, formed in one piece with the plate 20, is connected. A stepped edge 24 of the handle 22 forms an abutment 26 which limits the insertion of the fuse 10 into a holder (not shown). Extending parallel to each other and parallel to the upper surface 28 and the lower surface 30 (see FIG. 3) of the plate 20 are two insertion passages 32 (see FIG. 2) for receiving the connecting wires 18. In a centre portion of the length of the insertion passages 32 two substantially rectangular openings 34 are provided passing through the plate 20. Each opening 34 has two sections, a shorter lower section 36 (viewed in the axial direction of the insertion passages 32) (see FIG. 3) and a longer upper section 38.

When assembling the fuse element 14 with the insulating body 12, the connecting wires 18 are inserted into the passages 32 until they contact the inner ends 40 of these passages. Then, by means of a pressure stamp (not shown) introduces into the opening 34 through their lower positions 36, the connecting wires 18 are pressed upwardly into the region of the upper portions 38 of the openings 34 until the wires 18 project slightly above the upper surface 28 of the insulating body 12. Simulataneously, the particular connecting wires 18 can be pressed flat near the bent-out portion by compression between the pressure stamp and a counter-pressure plate (not shown), as may be seen from FIGS. 1 and 3, in order to form a wide contact surface 42 for making contact with the countercontacts of the holder. As can be seen, the fuse element 14 can now no longer slide out of the insertion passages 32. The connecting wires 18 serve, in this manner, both for securing the fuse element 14 to the insulating body 12 and for providing contacts for connection with corresponding countercontacts of the holder. Since the connecting wires 18 project outwardly above the surface 28 of the insulating body 12 by their contact surfaces 42 near the openings 34, the countercontacts in the holders may be formed by simple contact parts. At the same time, the elasticity of the bent-out portions 44 formed by the connecting wire 18 near the opening 34, ensures that the contact surface 42 is tensioned against the corresponding countercontact and thus a good contact may be established between the connecting wires 18 and the countercontacts of the holder.

When the fuse element 14 has broken the circuit due to over-heating of the electrical appliance and has thus become unusable, it can be replaced in a simple manner by the entire fuse 10 being removed from the holder and a new one inserted.

Figure 2:
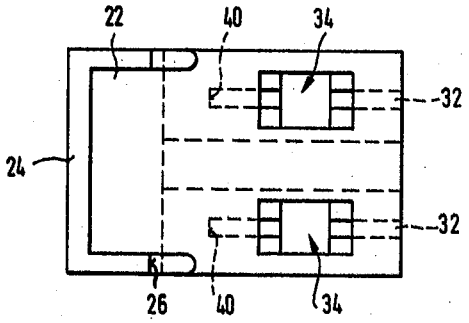
FIG. 2 is a plan view of the insulating body of the fuse shown in FIG. 1.
Figure 3:
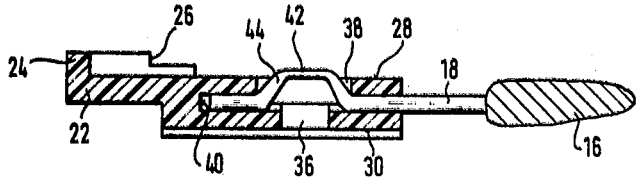
FIG. 3 is a section taken on the line III—III of FIG. 1.

The second embodiment 46 of the thermal fuse of the present invention, shown in FIGS. 4 to 7 differs from that shown in FIGS. 1 to 3, in the construction of the insulating body 48. On the other hand, the fuse element 14 corresponds to the fuse element shown in FIGS. 1 and 3, therefore like reference numerals are used for like parts in this case.

The insulating body 48 comprises a substantially rectangular flat plate 50 having a handle 52 attached in the manner shown. Insertion passages 54, for receiving the connecting wires 18 of the fuse element 14, are formed in the plate 50 in the same manner as passages 32 for the first embodiment. Openings 56 are provided which have a substantially rectangular cross-section and extend through the entire plate 50 perpendicularly to the axis of the passages 54 in a center portion of the length of the insertion passages 54.

The openings 56 are limited by a wide edge strip 58 at the outside edges of the plate 50 and by a narrow strip 60 on the inside of the plate 50. Both strips 58 and 60 are separated from a center rib 62 by through slots 64.

Figure 5:
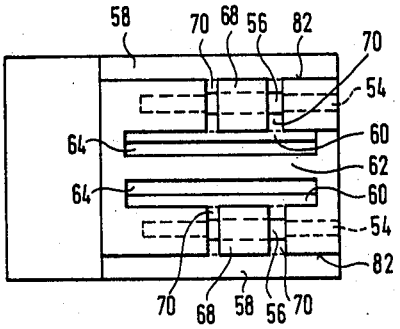
FIG. 5 is a view from below of the insulating body of the fuse shown in FIG. 4.
Figure 7:
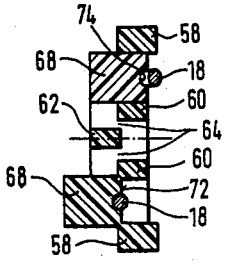
FIG. 7 is a section taken on the line VII—VII of FIG. 4, the lower half showing the fuse before the insertion of the pressure member, and the upper half the fuse after the insertion of the pressure member.

As may be seen in FIG. 5, on the underside 66 of the plate 50, the openings 56 are largely covered by two pressure blocks 68, the width of each of which, perpendicularly to the axial direction of the insertion passages 54 and parallel to the plane of the plate 50, is slightly greater than the width of the openings 56. The pressure blocks 68 in the case of the insulating body 48 not yet connected to the fuse element 14 are connected by thin bars 70 to the lower edges of the strips 58 and 60 so that they are disposed by their respective upper surfaces 72 approximately on a plane extending through the axes of the passages (FIG. 7). At the same time the pressure blocks 68 have a channel 74 in their upper surfaces 72 which extends co-axially to the respective insertion passage 54, so that the pressure blocks 68 do not prevent the insertion of the connecting wires 18 into the insertion passages 54.

As may be seen in the lower half of FIG. 7, the pressure blocks 68 project from the lower surface of the insulating body 48 before assembling the fuse element 14 on insulating body 48. If, after the insertion of the connecting wires 18 in the insertion passages 54, the body 48 is clamped between two flat plates extending parallel to the plane of the plate 50, the pressure blocks 68 are pressed in between the edge strips 58 and 60, and the bars 70 are torn away. The blocks 68 thus press the connecting wires 18 upwardly into the openings 56 so that they are bent in the form of an arc (see FIG. 6). An edge bead 76 extending around the upper side of the plate 50 ensures that the connecting wires 18 can project above the surface 78 of the plate 50 near the openings 56 without being hindered by a clamping plate in contact therewith.

Figure 4:
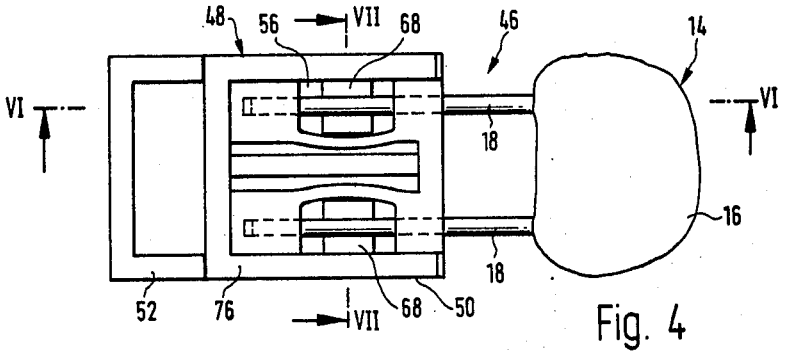
FIG. 4 is a plan view of a thermal fuse according to a second embodiment of the present invention.

The pressure blocks 68 are held between the respective edge strips 58 and 60 since the thin inner edge strip 60 is slightly deformed, as shown in FIG. 4, and this thus retains the pressure block 68 in its inserted position due to the elastic properties of the plastic material of which the body 48 is constructed.

Figure 6:
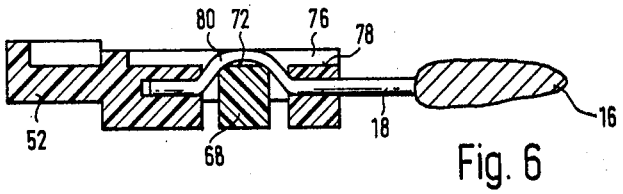
FIG. 6 is a section taken on the line VI—VI of FIG. 4.

As may be seen from FIG. 6, the arcuate portion 80 of the connecting wire 18 does not lie flat in the channel 74 of the pressure block 68 but is raised above it with a degree of play. This play ensures that the arcuate portion 80 is in contact with an associated countercontact of the holder with a certain degree of resilience after the insertion of the fuse 46 in its corresponding holder.

As may be seen from the above description, the insulating body 48, together with the pressure blocks 68, may be made in one piece as an injection moulded part. The assembling of the fuse element 14 to the insulating body 48 may be effected for example by means of a simple pair of flat pliers in that the insulating body 48 is clamped between the jaws of the pliers and the pressure blocks 68 are pressed into the openings 56. Therefore no special tools are required for assembling.

It should also be mentioned that the recesses 82 in the edges, shown in FIG. 5 and extending parallel to the insertion passages 54 are determined not only by the break-off construction of the pressure blocks 68 but they also make it possible, in cooperation with a specific holder, to produce a non-interchangeable type of thermal fuse for a certain type of appliance, for example, a certain type of coil body. For instance, it must not be possible for a fuse for 110° C. to be inserted into a transformer which is limited to a temperature of 98° C.

I claim:

1. A thermal fuse for electrical apparatus, said fuse being insertable, in use, in a holder formed in the apparatus or capable of being fitted therein, and comprising a thermally influenceable fuse element with connecting wires and an insulating body for holding the fuse element, said fuse element being securable to the insulating body by means of its connecting wires in such manner that the connecting wires are contactable by by countercontacts of the holder, the insulating body being provided with insertion passages for receiving the connecting wires and having in a center portion of the length of the insertion passages, at least one opening extending substantially perpendicularly to the axis of the passage, so that the connecting wire introduced into the said at least one insertion passage is located at least partially free in a center portion of its length.

2. A thermal fuse according to claim 1, in which the openings are dimensioned so that the connecting wire can be bent out of the axis of the passage in the center portion of its length.

3. A thermal fuse according to claim 1 in which the openings extend through the entire insulating body transversely to the axes of the passages.

4. A thermal fuse according to claim 3, in which, in the region of the openings, on one side of the insertion passage, a pressure member, insertable in the opening is provided on the insulating body and, before being inserted, is removably connected by tear-off strips to said insulating body and projects, by its end remote from the passage, beyond the associated surface of the insulating body.

5. A thermal fuse according to claim 4, in which the pressure member is made in one piece with the insulating body and is connected thereto by means of a bridge of material which is thin relative to the insulating body and to the pressure member.

6. A thermal fuse according to claim 4 in which the width of the pressure members, measured transversely of the axis of the passage and of the direction of insertion, is slightly greater than the width of the openings, which are each limited on at least one side by a wall which is elastically deformable.

7. A thermal fuse according to claim 4 in which the dimension of the pressure members in the direction of insertion is approximately equal to the thickness of the insulating body, measured in the same direction.

8. A thermal fuse according to claim 4 in which, on the surface of the insulating body opposite to the pressure members in their initial position, ribs are formed, the height of which is approximately equal to the inner diameter of the insertion passage.

9. A thermal fuse according to claim 8, in which the ribs are formed as an edge bead enclosing the said surface.

10. A thermal fuse according to claim 4 in which the dimension of the pressure members transversely of the axis of the passage and of the direction of the insertion, is greater than the diameter of the insertion passage and the pressure members have a channel-like depression whose radius of curvature corresponds approximately to the radius of the insertion passages.

11. A thermal fuse according to claim 6 in which the insulating body is formed by a flat substantially rectangular plate in which the insertion passages extend substantially parallel to one another and to the plane of the plate and that the deformable walls are each limited, on the one hand, by the opening and, on the other hand, by an opening extending parallel to the insertion passages between said passages.

12. A thermal fuse according to claim 1 in which the insulating body has a handle.

13. A thermal fuse according to claim 1 in which the insulating body has stops for cooperating with complementary abutments of the holder.

* * * * *